US005400685A

United States Patent [19]

Cappella

[11] Patent Number: 5,400,685

[45] Date of Patent: Mar. 28, 1995

[54] DRUMSTICK HAVING RIGID RING AROUND TIP

[76] Inventor: Carmen J. Cappella, 21 Point of Wood Dr., North Brunswick, N.J. 08902

[21] Appl. No.: 147,387

[22] Filed: Nov. 3, 1993

Related U.S. Application Data

[63] Continuation-in-part of Ser. No. 892,198, Jun. 2, 1992, Pat. No. 5,260,506.

[51] Int. Cl.[6] ..... G10D 13/02

[52] U.S. Cl. ..... 84/422.4

[58] Field of Search ..... 84/422.4

[56] References Cited

U.S. PATENT DOCUMENTS 2,853,912 9/1958 Gladstone ..... 84/422.4
3,217,581 11/1965 Hinger ..... 84/422.4
3,998,123 12/1976 Hinger ..... 84/422.4
5,179,237 1/1993 Grossman ..... 84/422.4

OTHER PUBLICATIONS

Principles of Materials Science and Engineering, William Fortune Smith, 1986, pp. 342–347.

*Primary Examiner*—M. L. Gellner
*Assistant Examiner*—Cassandra C. Spyrou
*Attorney, Agent, or Firm*—Joel F. Spivak

[57] ABSTRACT

A drumstick, such as a conventional solid wooden drumstick has a plastic conformal cap affixed over the striking tip of the drumstick. The cap is provided with a shallow circumferential groove and a hard, rigid impact ring affixed within the groove, the surface of the ring extending above the surface of the cap so that the ring impacts the precussion instrument used with the drumstick.

9 Claims, 1 Drawing Sheet

DRUMSTICK HAVING RIGID RING AROUND TIP

This application is a continuation in part of my copending application, Ser. No. 07/892,198, filed Jun. 2, 1992 now Pat. No. 5,260,506.

FIELD OF THE INVENTION

This invention relates generally to a drumstick, but more particularly to an improved drumstick having a tone enhancing ring around the striking tip of the drumstick.

DESCRIPTION OF THE PRIOR ART

It is well known in the art that various problems and difficulties are encountered in providing a drumstick that is capable of withstanding the severe abuse under the playing techniques demanded by present-day percussionists while still delivering a high quality sound, especially when used on cymbals.

The conventional solid wood drumstick ranges from about 15" to 18" in length and includes a cylindrical shaft, a tapered neck and an ovular or spherical tip portion. Such a drumstick has long been the most widely used type of drumstick. The popularity of the wooden drumstick is based upon its optimal mix of characteristics with respect to sound reproduction, weight, distribution of weight, durability, flexibility, resilience, shock absorbability and overall "feel". Conventional wooden drumsticks suffer nonetheless from certain inherent disadvantages, chief among them being chipping, splintering, cracking and somewhat less that desirable tonal quality when used with cymbals.

The prior art is replete with examples of other and non-conventional drumsticks in an attempt to avoid one or more of the disadvantages of conventional solid wooden drumsticks. For example, U.S. Pat. Nos. 4,300,438 and 4,305,544 disclose drumsticks made of impregnated woven fabric; U.S. Pat. No. 3,722,350 discloses the use of a metallic drumstick having a hollowed out shaft while U.S. Pat. No. 4,202,241 employs plastic as the primary drumstick material. Others have employed composites as the primary material.

All of the prior art drumsticks, however, share the common goal of optimizing, through tradeoffs, the properties of tonal reproduction, weight, weight distribution, durability, flexibility, resilience, shock absorbability and overall feel generally found in conventional wooden drumsticks.

I have now developed a drumstick which not only has improved durability, resilience and shock absorbability as well as improved tonal quality especially with respect to use with cymbals but retains the overall feel of the drumstick.

SUMMARY OF THE INVENTION

The drumstick of the present invention comprises a shaft portion and a tip portion for striking the drum or cymbal wherein the tip portion is provided with a hard, rigid ring, circumferentially affixed around the periphery of the tip such that the outer surface of the ring is somewhat raised with respect to the surface of the remainder of the tip so that the ring impacts the drum or cymbal when the drumstick is in use.

In the preferred embodiment of the invention, the drumstick is provided with a plastic cap which is affixed over the tip of the drumstick and the ring is affixed circumferentially to the plastic cap. When used with a wooden drumstick, improved durability, resilience, shock absorbability and tonal quality can be achieved without adversely affecting weight, balance or overall feel of the instrument.

DETAILED DESCRIPTION OF THE INVENTION

It should be understood that while the present invention is described in terms of conventionally shaped solid wooden drumsticks, the novel feature of the invention is applicable to essentially any type of drumstick regardless of material, shape, whether solid or hollow, or other deviation from the conventional drumstick.

Figure 1:
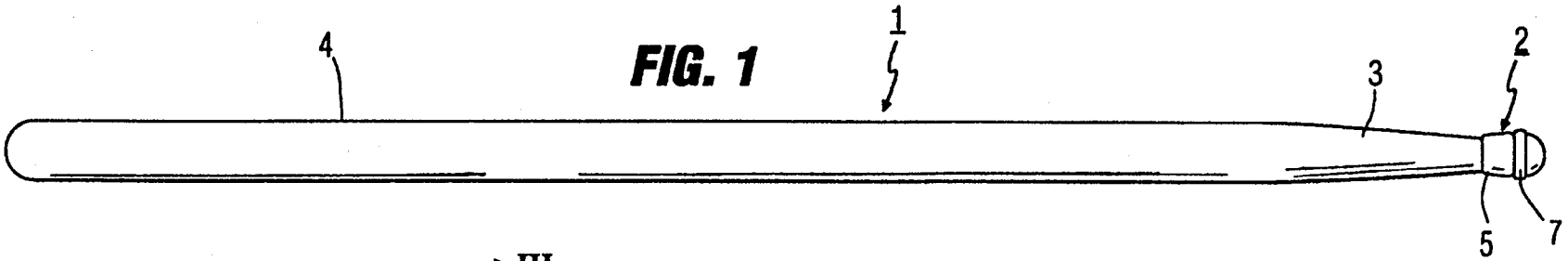
FIG. 1 is a side elevatinal view of the drumstick in accordance with the present invention.

Referring to FIG. 1, there is shown a solid wooden drumstick 1 of conventional size and shape having a spherical or ovular bulbous striking tip 2 from which there extends rearwardly a tapered neck portion 3 and thence a cylindrical shaft or handle portion 4.

In accordance with the preferred embodiment of the present invention, the striking tip 2 is provided with a plastic cap 5 affixed thereover. The plastic cap 5 is preferably force fit, molded, cemented or otherwise affixed to the tip 2 so that it does not move or rotate. Preferred plastics for the cap material are those which are not brittle and possess good impact resistance, resilience and shock absorbability and can be adhered to the underlying drumstick tip 2. Examples of useful materials are nylon, polyethylene, polypropylene and the hard rubbers such as the butadienes. Nylon is the preferred material.

The plastic cap 5, as shown, is provided with a shallow groove 6 circumferentially around the periphery thereof. A hard, rigid ring 7 is provided within the groove 6, preferably in a manner so that it does not move or rotate therein. The outer surface of the ring 7 is somewhat raised from the surface of the cap 5 such that upon impact of the drumstick 1 with a cymbal, the ring 7 will impact before the remainder of the striking tip 2. Generally, any hard, rigid material which imparts a desired tonal quality can be used for the ring, metals and metal alloys being preferred. While essentially any metal or alloy is suitable for use as the ring, it is preferred to utilize rust resistant materials such as brass, copper, nickel, chromium or stainless steel. Brass has been found to provide excellent tonal qualities especially when the drumstick is used with cymbals and does not cause damage to the cymbals. Other hard, rigid materials suitable for use as an impact ring include graphite; ceramics such as sintered oxides, carbides and nitrides; and hard, rigid plastics such as polycarbonate, polyamide, polyvinychloride, phenol-formaldehyde, polymethylmethacrylate and polypropylene.

By providing the tip assembly, including the cap and ring, on a conventional wooden drumstick, the problem of chipping, splintering and cracking of the drumstick are greatly diminished while enhancing other attributes of the drumstick.

One method of assembling the novel drumstick when the cap is made of a plastic such as nylon and the ring is a metallic alloy such as brass or one of the other mentioned materials, is to heat the cap with moist heat, and while hot, press fit the metal ring onto the cap so that it lies in the circumferential groove of the cap. An appropriate glue or cement is then applied to the inner surface of the cap and/or the tip of the drumstick and the tip of the drumstick is press fit into the cap. The glue is then allowed to dry. Other techniques are also possible as well as will be apparent to those skilled in the art. For example, the cap material may be formed or molded directly onto the drumstick tip and the ring applied thereafter by first hearing the ring to expand it and then pressing the expanded ring into place over the cap and the allowing it to cool.

Figure 2:
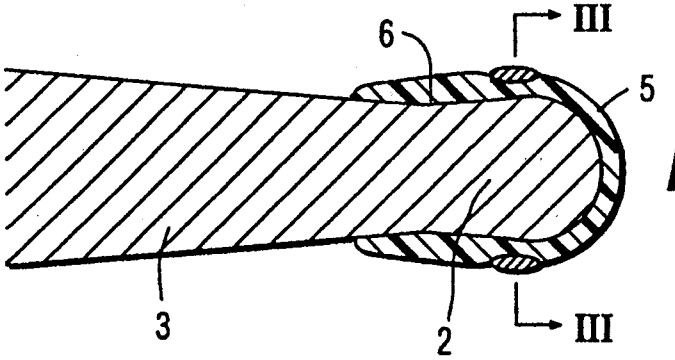
FIG. 2 is a side cross-sectional view of the tip and tapered shaft portions of the drumstick of FIG. 1.
Figure 3:
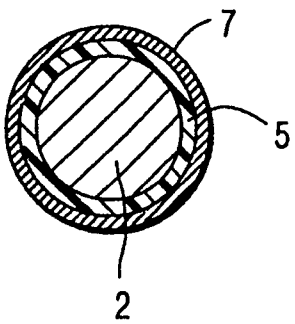
FIG. 3 is a front cross-sectional view of the tip of the drumstick shown in FIG.
Figure 4:
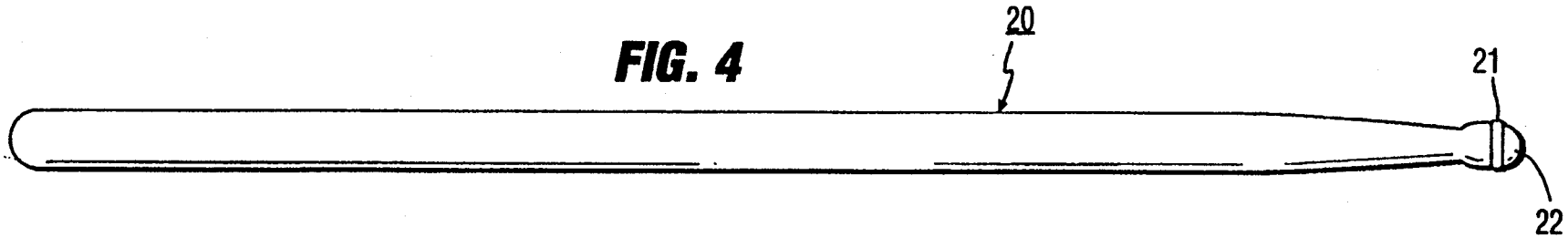
FIG. 4 is a side elevational view of another embodiment of the invention.

Referring to FIG. 4, there is shown a conventional type drumstick 20 similar to that described with references to FIGS. 1–3 except that in this embodiment, the ring 21 is affixed directly to the tip 22 of the drumstick 20 without the use of a plastic cap.

As previously stated, the novel feature of the invention described herein is also suitable for use and should also enhance the performance of drumsticks other than the conventional wooden drumstick. For example, the ring, or cap and ring can be applied to any of the prior art drumsticks described in the previously mentioned issued patents.

While the invention as described in terms of the preferred embodiment employs a plastic cap and a metal ring, it should be understood that the invention should not be limited by the use of such materials. For example, it is contemplated that one could form a cap over the tip of a drumstick out of materials other than plastics, including for example, rubber, ceramics, graphite and composites. Similarly, as previously set forth, the impacting ring material can be formed of materials other than metals, such as, graphite, ceramics, plastics and the like.

What I claim is:

1. A drumstick having a body comprising a shaft and a striking tip extending from one end of said shaft, said striking tip having a circumference and a hard, rigid percussion impact ring around said circumference said impact ring resting within a groove provided around said circumference such that an outer surface of said impact ring is raised as compared with the surface of the striking tip adjacent the ring and wherein the impact ring is comprised of a material selected from a group consisting of graphite, ceramics and plastics.

2. The drumstick recited in claim 1 wherein said impact ring is a plastic selected from a group consisting of polycarbonate, polyamide, polyvinyl chloride, phenol formaldehyde, polymethyl methacrylate, and polypropylene.

3. A drumstick having a body comprising a cylindrical shaft and a striking tip extending from one end of said shaft, said striking tip having a conformal cap thereover, and said cap having a hard, rigid percussion impact ring circumferentially therearound wherein the impact ring is ceramic, graphite or plastic.

4. The drumstick recited in claim 3 wherein the cap is plastic.

5. The drumstick recited in claim 3 wherein the impact ring is formed from a plastic selected from a group consisting of polycarbonate, polyamide, polyvinyl chloride, phenol formaldehyde, polymethyl methacrylate, and polypropylene.

6. The drumstick recited in claim 3 wherein the cap is nylon.

7. The drumstick recited in claim 3 wherein the impact ring is affixed to the cap and the cap is affixed to the striking tip such that neither the ring nor the cap are moveable.

8. A drumstick having a body comprising a cylindrical shaft and a striking tip extending from one end of said shaft, said striking tip having a conformal cap thereover, and said cap having a hard, rigid percussion impact ring circumferentially therearound and wherein the cap has a hollow groove therearound and said impact ring is positioned within said groove, an outer surface of said impact ring being raised with respect to the surface of the cap and wherein the cap is plastic and the impact ring is graphite, ceramic or plastic.

9. The drumstick recited in claim 8 wherein the body of the drumstick is wood and the impact ring is polycarbonate, polyamide, polyvinyl chloride, phenol formaldehyde, polymethyl methacrylate, or polypropylene.

* * * * *